US009279293B2

(12) United States Patent
Izbinski

(10) Patent No.: US 9,279,293 B2
(45) Date of Patent: Mar. 8, 2016

(54) DRILL BIT WITH EXTENDABLE GAUGE PADS

(71) Applicant: Konrad Izbinski, The Woodlands, TX (US)

(72) Inventor: Konrad Izbinski, The Woodlands, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 384 days.

(21) Appl. No.: 13/861,870

(22) Filed: Apr. 12, 2013

(65) Prior Publication Data

US 2014/0305703 A1 Oct. 16, 2014

(51) Int. Cl.
*E21B 10/62* (2006.01)
*E21B 10/32* (2006.01)

(52) U.S. Cl.
CPC ..... *E21B 10/62* (2013.01); *E21B 10/322* (2013.01)

(58) Field of Classification Search
CPC ..... E21B 10/62; E21B 10/20; E21B 10/322; E21B 10/43; E21B 17/1092
See application file for complete search history.

(56) References Cited

U.S. PATENT DOCUMENTS

| | | | | |
|---|---|---|---|---|
| 4,842,083 | A * | 6/1989 | Raney | 175/325.4 |
| 5,560,440 | A * | 10/1996 | Tibbitts | 175/384 |
| 6,142,250 | A * | 11/2000 | Griffin et al. | 175/381 |
| 6,971,459 | B2 * | 12/2005 | Raney | 175/408 |
| 7,971,662 | B2 | 7/2011 | Beuershausen | |
| 2008/0000693 | A1 | 1/2008 | Hutton | |
| 2009/0044979 | A1 | 2/2009 | Johnson et al. | |
| 2009/0065262 | A1 * | 3/2009 | Downton et al. | 175/393 |
| 2010/0071956 | A1 | 3/2010 | Beuershausen | |
| 2010/0071962 | A1 | 3/2010 | Beuershausen | |
| 2012/0318580 | A1 | 12/2012 | Oesterberg | |
| 2014/0305703 | A1 * | 10/2014 | Izbinski | 175/40 |

OTHER PUBLICATIONS

International Search Report and Written Opinion; International Application No. PCT/US2014/033728; International Filing Date: Apr. 11, 2014; Date of Mailing: Jul. 24, 2014; pp. 1-17.

* cited by examiner

*Primary Examiner* — Daniel P Stephenson
(74) *Attorney, Agent, or Firm* — Cantor Colburn LLP

(57) ABSTRACT

A drilling system that includes a bit body that has a longitudinal axis, a blade of a selected length on a side of the bit body and substantially along the longitudinal axis, and a movable member associated with the blade that extends from a retracted position to a selected extended position along the longitudinal axis, thereby effectively extending the length of the blade when the movable member is in the selected extended position.

22 Claims, 4 Drawing Sheets

DRILL BIT WITH EXTENDABLE GAUGE PADS

BACKGROUND INFORMATION

1. Field of the Disclosure

This disclosure relates generally to drill bits and systems that utilize same for drilling wellbores.

2. Background of the Art

Oil wells (also referred to as "wellbores" or "boreholes") are drilled with a drill string that includes a tubular member having a drilling assembly (also referred to as the "bottom-hole assembly" or "BHA") at the bottom end of the tubular. The BHA typically includes devices and sensors that provide information relating to a variety of parameters relating to the drilling operations ("drilling parameters"), behavior of the BHA ("BHA parameters") and parameters relating to the formation surrounding the wellbore ("formation parameters"). A drill bit attached to the bottom end of the BHA is rotated by rotating the drill string and/or by a drilling motor (also referred to as a "mud motor") in the BHA to disintegrate the rock formation to drill the wellbore. A large number of wellbores are drilled along contoured trajectories. For example, a single wellbore may include one or more vertical sections, deviated sections and horizontal sections through differing types of rock formations. Drilling conditions differ based on the wellbore contour, rock formation and wellbore depth. Excessive vibrations, stick-slip and whirl often occur during drilling. It is often desirable to have a drill bit with a longer vertical or longitudinal sections around the drill bit, also referred to as gauge pads, during drilling of a vertical well section and a relatively short gauge pads for drilling deviated and horizontal well sections to reduce or control stick-slip, vibration and whirl.

The disclosure herein provides a drill bit and drilling systems using the same that includes adjustable longitudinal sections or gauge pads.

SUMMARY

In one aspect, a drill bit is disclosed that in one embodiment includes a bit body that has a longitudinal axis, a blade of a selected length on a side of the bit body and substantially along the longitudinal axis, and a member associated with the blade that extends from a retracted position to a selected extended position along the longitudinal axis, thereby effectively extending the length of the blade when the movable member is in the selected extended position.

In another aspect, a method of drilling a wellbore is provided that in one embodiment includes: conveying a drill string having a drill bit at an end thereof, wherein the drill bit includes a bit body that has a longitudinal axis, a blade of a selected length on a side of the bit body and substantially along the longitudinal axis, and a movable member associated with the blade that extends from a retracted position to a selected extended position along the longitudinal axis, thereby effectively extending the length of the blade when the movable member is in the selected extended position and drilling the wellbore using the drill string with the movable member in an extended position during at least a portion of the wellbore.

In another aspect, a method of making a drill bit is disclosed that in one embodiment may include; providing a drill bit having a blade of a selected length along a side of the bit body, the bit body having a longitudinal axis; and providing a movable member associated with the blade that extends from a retracted position along the longitudinal axis to a selected distance that effectively extends the length of the blade.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures, wherein like numerals have generally been assigned to like elements and in which.

DESCRIPTION OF THE EMBODIMENTS

Figure 1:
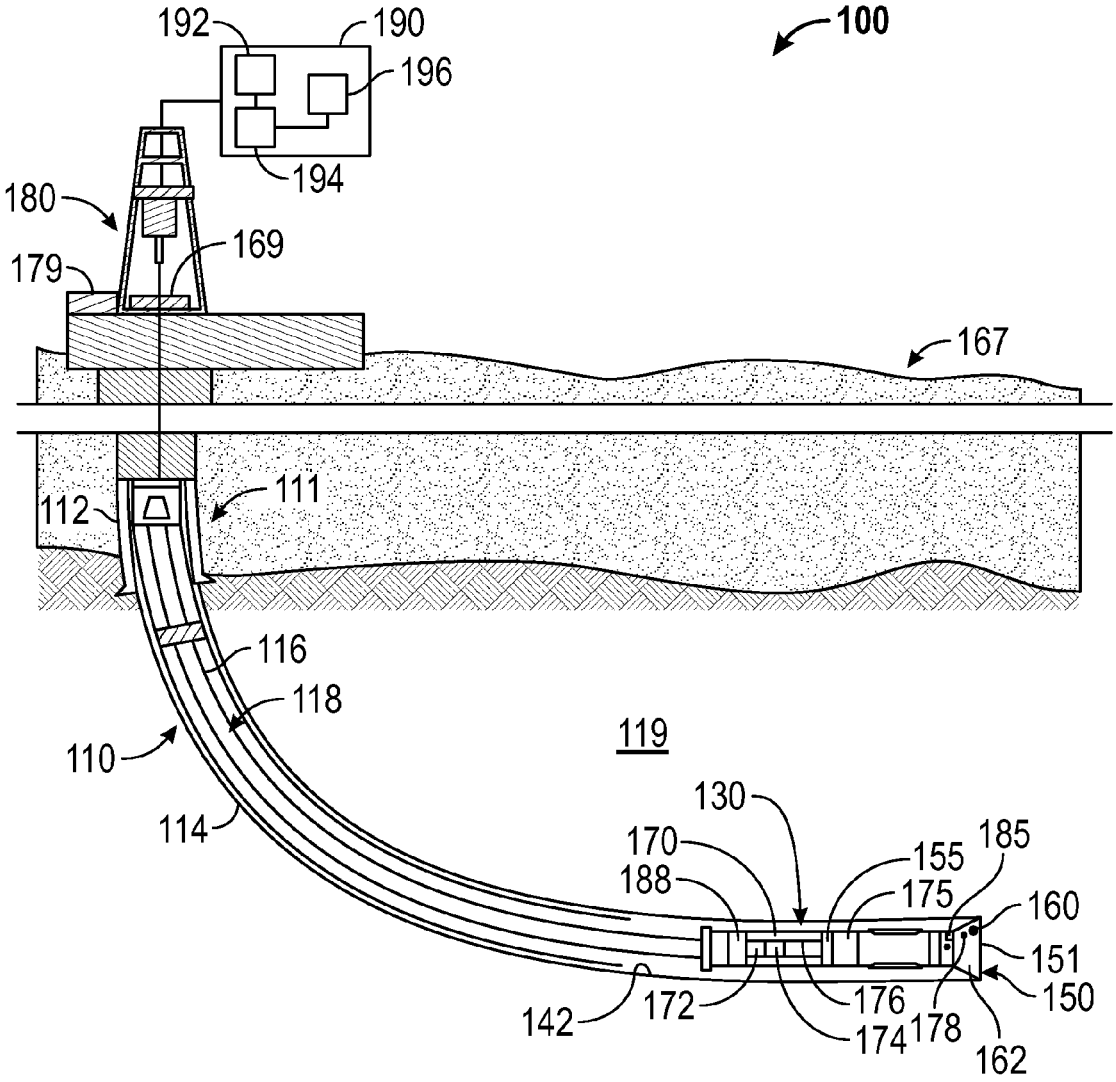
FIG. 1 is a schematic diagram of an exemplary drilling system that includes a drill string that has a drill bit made according to one embodiment of the disclosure.

FIG. 1 is a schematic diagram of an exemplary drilling system 100 that may utilize drill bits made according to the disclosure herein. FIG. 1 shows a wellbore 110 having an upper section 111 with a casing 112 installed therein and a lower section 114 being drilled with a drill string 118. The drill string 118 is shown to include a tubular member 116 with a BHA 130 attached at its bottom end. The tubular member 116 may be made up by joining drill pipe sections or it may be a coiled-tubing. A drill bit 150 is shown attached to the bottom end of the BHA 130 for disintegrating the rock formation 119 to drill the wellbore 110 of a selected diameter.

Drill string 118 is shown conveyed into the wellbore 110 from a rig 180 at the surface 167. The exemplary rig 180 shown is a land rig for ease of explanation. The apparatus and methods disclosed herein may also be utilized with an offshore rig used for drilling wellbores under water. A rotary table 169 or a top drive (not shown) coupled to the drill string 118 may be utilized to rotate the drill string 118 to rotate the BHA 130 and thus the drill bit 150 to drill the wellbore 110. A drilling motor 155 (also referred to as the "mud motor") may be provided in the BHA 130 to rotate the drill bit 150. The drilling motor 155 may be used alone to rotate the drill bit 150 or to superimpose the rotation of the drill bit 150 by the drill string 118. A control unit (or controller) 190, which may be a computer-based unit, may be placed at the surface 167 to receive and process data transmitted by the sensors in the drill bit 150 and the sensors in the BHA 130, and to control selected operations of the various devices and sensors in the BHA 130. The surface controller 190, in one embodiment, may include a processor 192, a data storage device (or a computer-readable medium) 194 for storing data, algorithms and computer programs 196. The data storage device 194 may be any suitable device, including, but not limited to, a read-only memory (ROM), a random-access memory (RAM), a flash memory, a magnetic tape, a hard disk and an optical disk. During drilling, a drilling fluid 179 from a source thereof is pumped under pressure into the tubular member 116. The drilling fluid discharges at the bottom of the drill bit 150 and returns to the surface via the annular space (also referred as the "annulus") between the drill string 118 and the inside wall 142 of the wellbore 110.

Still referring to FIG. 1, the drill bit 150 includes a face section (or bottom section) 151. The face section 151 or a portion thereof faces the formation in front of the drill bit or the wellbore bottom during drilling. The drill bit 150, in one aspect, includes one or more adjustable longitudinal members or pads 160 along the longitudinal or vertical side 162 of the drill bit 150. The members 160 are "extensible members" or "adjustable members". A suitable actuation device (or actuation unit) 185 in the drill bit 150 may be utilized to activate the members 160 during drilling of the wellbore 110. Signals corresponding to the extension of the members 160 may be provided by one or more suitable sensors 178 associated with the members 160 or associated with the actuation units 185.

The BHA 130 may further include one or more downhole sensors (collectively designated by numeral 175). The sensors 175 may include any number and type of sensors, including, but not limited to, sensors generally known as the measurement-while-drilling (MWD) sensors or the logging-while-drilling (LWD) sensors, and sensors that provide information relating to the behavior of the BHA 130, such as drill bit rotation (revolutions per minute or "RPM"), tool face, pressure, vibration, whirl, bending, and stick-slip. The BHA 130 may further include a control unit (or controller) 170 configured to control the operation of the members 160 and for at least partially processing data received from the sensors 175 and 178. The controller 170 may include, among other things, circuits to process the sensor 175 and 178 signals (e.g., amplify and digitize the signals), a processor 172 (such as a microprocessor) to process the digitized signals, a data storage device 174 (such as a solid-state-memory), and a computer program 176. The processor 172 may process the digitized signals, control the operation of the pads 160, process data from other sensors downhole, control other downhole devices and sensors, and communicate data information with the controller 190 via a two-way telemetry unit 188. In one aspect, the controller 170 in the BHA or a controller 185 in the drill bit 150 or the controller 190 at the surface or any combination thereof may adjust the extension of the pads members 160 to control the drill bit fluctuations and/or drilling parameters to increase the drilling effectiveness and to extend the life of the drill bit 150 and the BHA. Increasing the pad extension provides a longer vertical section or gauge pad section along the drill bit and acts as a stabilizer, which can effectively reduce vibration, whirl, stick-slip, vibration, etc.

Figure 2:
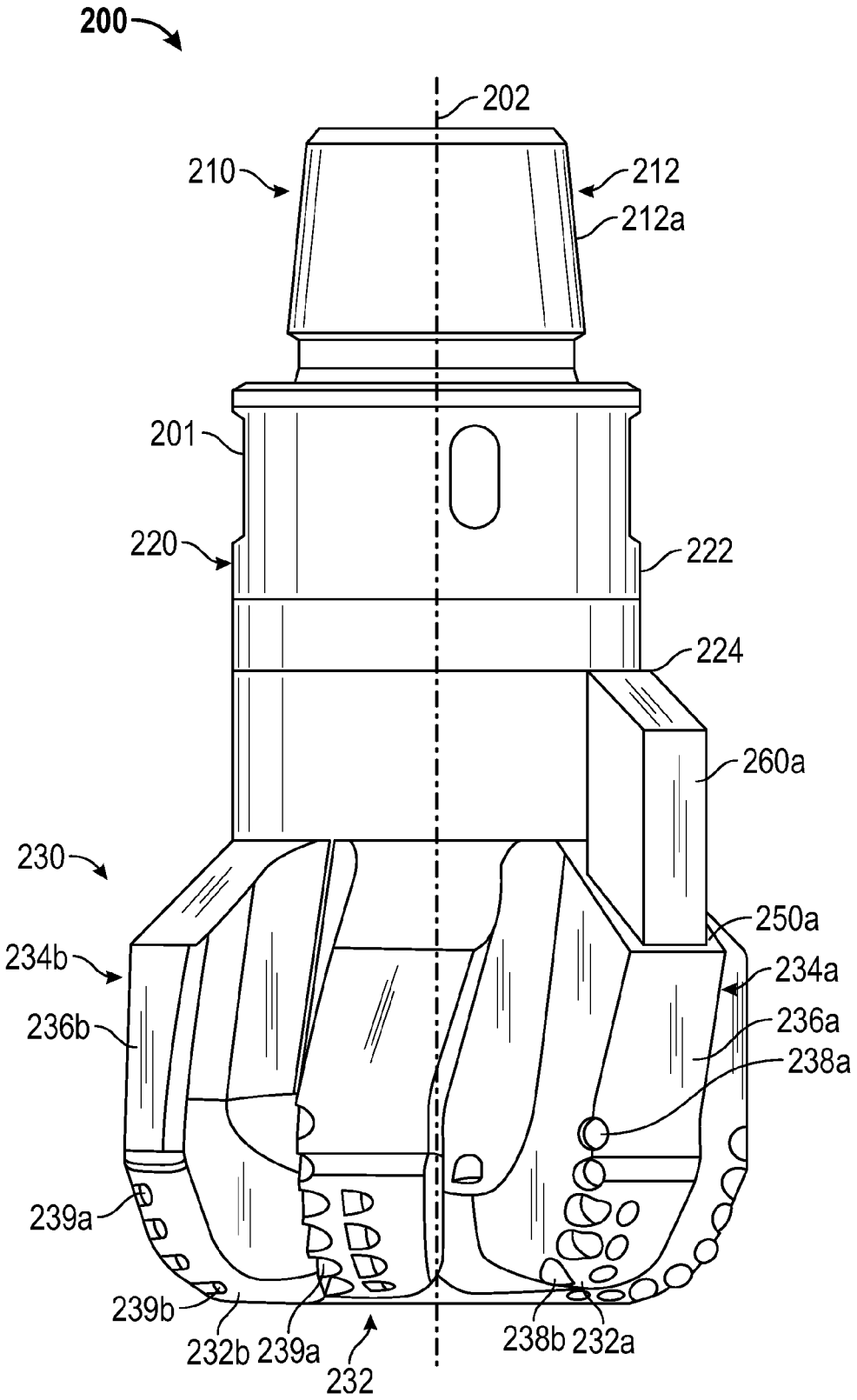
FIG. 2 shows an isometric view of an exemplary drill bit with an adjustable member on a blade, according to one embodiment of the disclosure.

FIG. 2 shows an exemplary drill bit 200 made according to one embodiment of the disclosure. The drill bit 200 is a polycrystalline diamond compact (PDC) bit having a bit body 201 that includes a neck or neck section 210, a shank 220 and a crown or crown section 230. The neck 210 has a tapered threaded upper end 212 having threads 212*a* thereon for connecting the drill bit 200 to a box end of the drilling assembly 130 (FIG. 1). The shank 220 has a lower vertical or straight section 222. The shank 220 is fixedly connected to the crown 230 at joint 224. The crown 230 includes a face or face section 232 that faces the formation during drilling. The crown includes a number of blades, such as blades 234*a*, 234*b*, etc. A typical PDC bit includes 3-7 blades. Each blade has face (also referred to as a "face section") and a side (also referred to as a "side section"). For example, blade 234*a* has a face 232*a* and a side 236*a* and blade 234*b* has a face 232*b* and a side 236*b*. The sides 236*a* and 236*b* extend longitudinally (substantially along or along or in the direction of) the longitudinal or vertical axis 202 of the drill bit 200. Each blade further includes a number of cutters. In the particular embodiment of FIG. 2, blade 234*a* is shown to include cutters 238*a* on a portion of the side 236*a* and cutters 238*b* along the face 232*a* while blade 234*b* is shown to include cutters 239*b* on face 232*b* and cutters 239*a* on side 236*b*.

Still referring to FIG. 2, the drill bit may further include one or more movable members that extend and retract (or reciprocate) axially. In one aspect, the movable members (also referred to herein as "movable pads") may be associated with one or more blades 234*a*, 234*b*, etc. FIG. 2 shows a configuration that includes a movable member 260*a* that reciprocates in a cavity or recess 250*a* in the blade 234*a*. The movable member 260*a* extend and retract along the axis 202 of the drill bit 200. In one aspect, the movable member may be selectively extended from a retracted location to an extended location. FIG. 2 shows the member 260*a* in a fully extended position. Member 260*a* may be extended to any location between the retracted location and the fully extended location by a device in the drill bit, in the drilling assembly or the surface as explained in more detail in reference to FIGS. 3 and 4. In another aspect, any number of the blades, such as blades 234*a*, 234*b*, etc. may include a movable member, such as member 260*a*.

Figure 3:
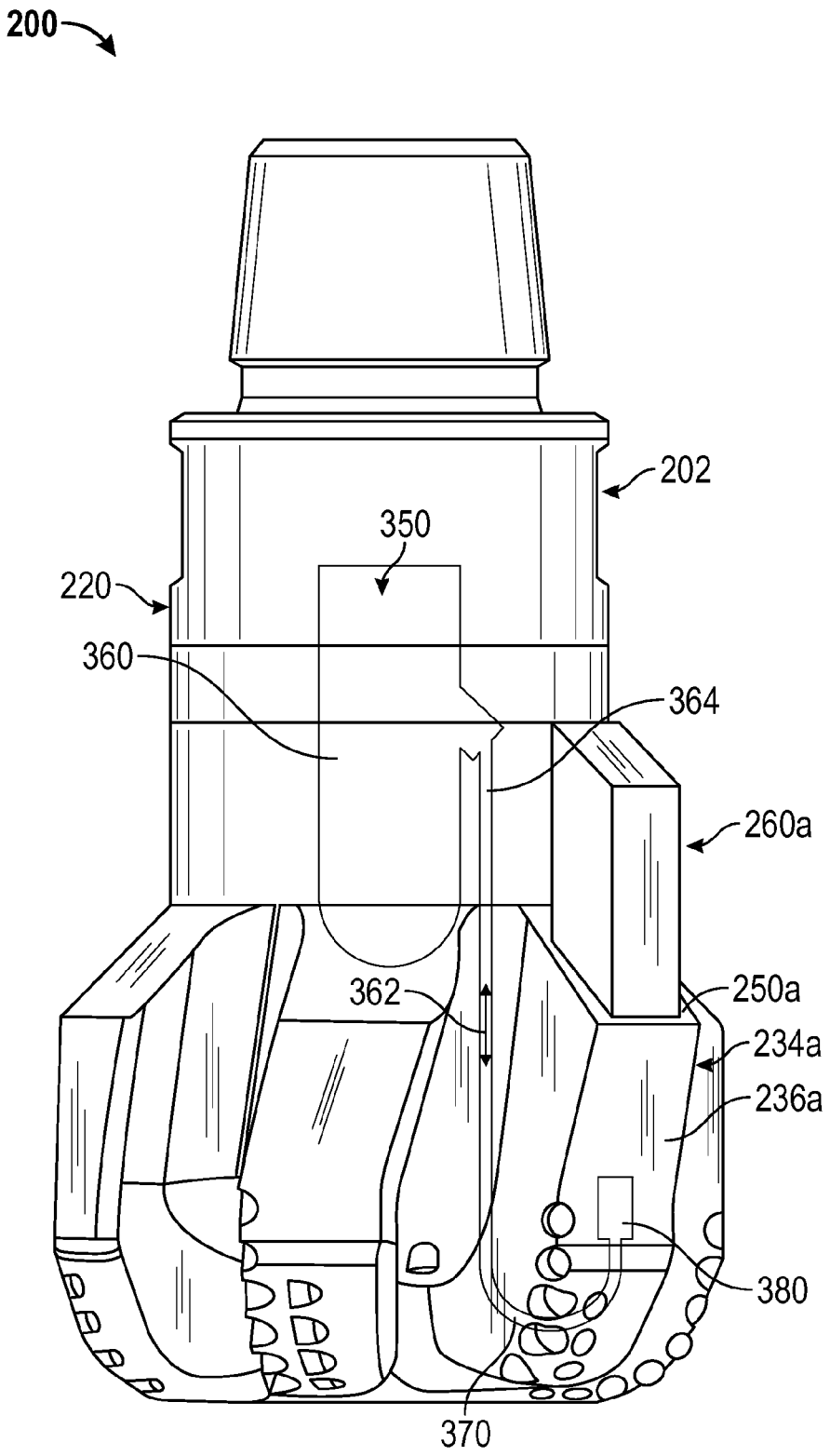
FIG. 3 is an isometric view of the exemplary drill bit of FIG. 2 showing a fluid control device for activating and deactivating the adjustable member during a drilling operation, according to one embodiment of the disclosure.

FIG. 3 shows the drill bit 200 that includes a device 350 for extending and retracting the movable member 260*a* within the cavity 250*a*, according to one embodiment of the disclosure. The device 350 may include a fluid supply unit or device 360 that supplies a fluid 362 under pressure via a fluid line 370 to a fluid acting unit or device 380. In one aspect, the fluid supply unit 360 may be housed or positioned at any suitable location in the drill bit 200. In one aspect, the fluid acting unit 380 may be placed in the recess 250*a* and is in fluid communication with the fluid supply unit 260 via the fluid line 370. As noted before, a suitable control unit or controller may control the operation of the device 350. In one aspect, the drill bit 200 may be manufactured with the movable member 260*a* biased to remain in a retracted position. During drilling, the device 350 is activated to cause the fluid supply unit 360 to supply fluid 362 to the fluid acting device 380. The fluid acting device extends or moves the movable member 360*a* a selected distance. The pressure applied by the fluid supply unit 360 may be varied to adjust the extension of the movable member 260*a*. When the pressure applied to the member is decreased, the biasing member accordingly retracts the member 260*a* into the recess 250*a*. Thus, the extension of the movable member 260*a* is adjustable in real time during operation of the drill bit.

Figure 4:
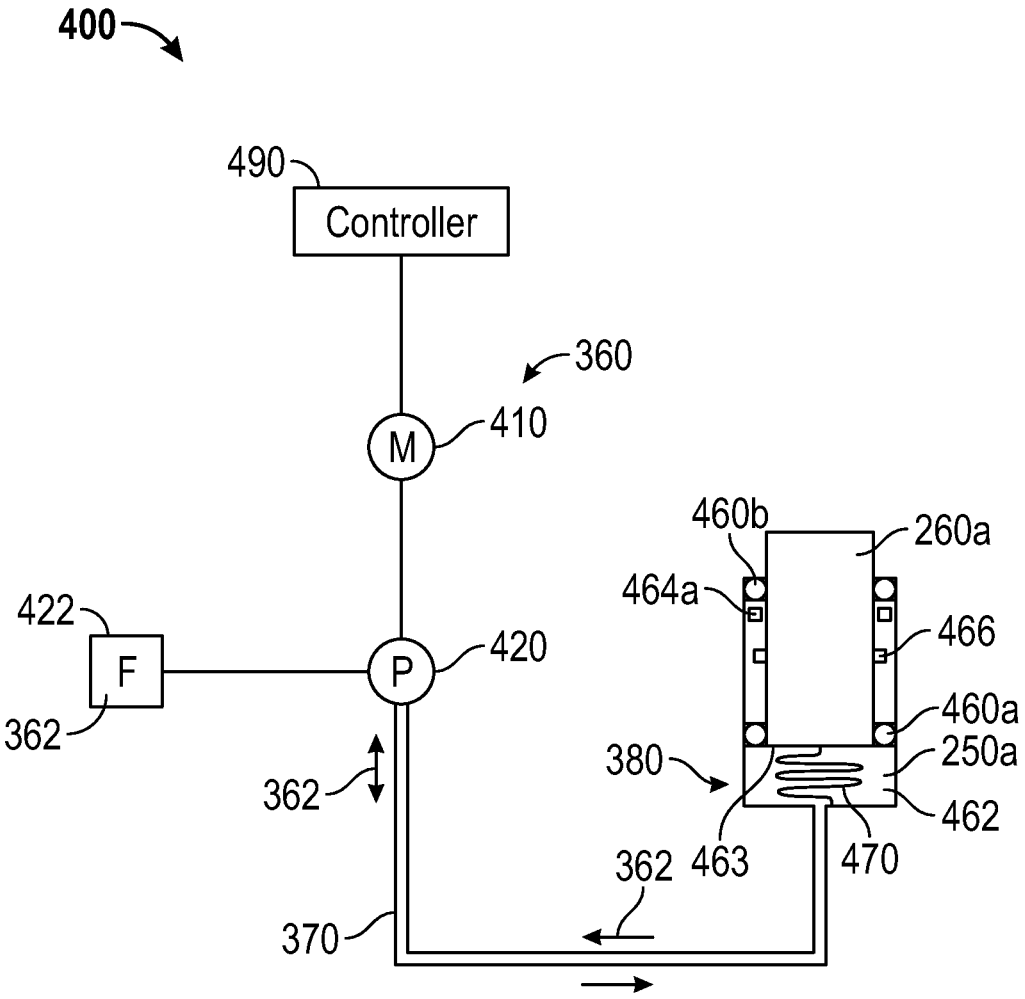
FIG. 4 is line diagram of an embodiment of a hydraulic circuit that may be utilized for activating and deactivating the adjustable member, according to an embodiment of this disclosure.

FIG. 4 shows a schematic diagram of a fluid circuit 400 that may be utilized to operate the fluid device 350 shown in FIG. 2. The fluid circuit 400 may include a motor 410 that drives a pump 420 that supplies fluid 362 from a source 422 thereof. The movable member 260*a* may be placed about seals 460*a* and 460*b* to reciprocate in the cavity 250*a*. When the device 250 is not in operation, a biasing member 470 coupled to a lower end 463 of the member retains the movable member 260*a* at a retracted position. When the motor 410 is turned a first direction, the pump 420 supplied the fluid 362 from the source 422 to a lower section 462 of the recess 250*a*. The fluid in the recess section 462 forces the movable member 260*a* to move or extend outside the cavity 250*a*. The amount of the fluid and the force applied thereby on the member 260*a* determines the amount of the extension. A mechanical stop 464 inside the cavity 250*a* and a stop 466 on the movable member 260*a* may be provided to limit or define the maximum extension of the movable member 260*a*. During drilling, when the motor 410 is turned in an opposite direction or the applied pressure by the fluid 362 is reduced, the biasing member 470 retracts the movable member into the cavity 250*a* proportionately. Thus, in operation, the movable member 260*a* may be extended from an initial position to a selected extended position in real time, thereby effectively adjusting the blade side or the gauge section of the drill bit 200. In one aspect, a drill bit made as described herein may be utilized as standard drill bit or a drill bit with an adjustable extended gauge section during drilling of a wellbore. Such a drill bit may be advantageous during bent sub/mud motor vertical drilling, because additional gauge length may aid in reducing whirl or wobble that occurs due to the bent sub. However, when the drill bit is in a slide mode, it can be advantageous to have a shorter gauge pad length.

The foregoing disclosure is directed to certain specific embodiments for ease of explanation. Various changes and modifications to such embodiments, however, will be apparent to those skilled in the art. It is intended that all such changes and modifications within the scope and spirit of the appended claims be embraced by the disclosure herein.

The invention claimed is:

1. A drill bit, comprising:

a bit body having a longitudinal axis;

a blade of a selected length on a side of the bit body and substantially along a longitudinal direction; and a movable member on the side of the bit body associated with the blade that extends from a retracted position to a selected extended position along the longitudinal axis to effectively extend the selected length of the blade when the movable member is in the selected extended position.

2. The drill bit of claim 1, wherein the movable member is placed inside the blade.

3. The drill bit of claim 2 further, comprises a device that extends and retracts the movable member.

4. The drill bit of claim 3, wherein the device comprises:

a fluid chamber and wherein the movable member is in fluid communication with the fluid chamber; and a device to supply a fluid under pressure to the fluid chamber to extend the movable member from a retracted position.

5. The drill bit of claim 3 further, comprising a biasing member that biases the movable member to cause the movable member to move toward the retracted position.

6. The drill bit of claim 3, wherein the device includes a motor that controls a pump to supply a fluid under pressure to move the movable member.

7. The drill bit of claim 6, wherein the fluid is one of: (i) drilling fluid flowing through the drill bit; and (ii) a hydraulic fluid stored in the drill bit.

8. The drill bit of claim 1, wherein the drill bit includes a plurality of blades, each blade including a separate movable member associated therewith that extends along the longitudinal axis of the drill bit.

9. The drill bit of claim 1, further comprising a sensor that provides information relating to n extension of the movable member.

10. The drill bit of claim 1 further, comprising a controller that controls an extension of the movable member.

11. A method of making a drill bit, comprising:

providing a drill bit having a blade of a selected length along a side of a bit body having a vertical axis; and providing a movable member on the side of the bit body that extends from a retracted position along the vertical axis to a selected extended position that effectively extends the selected length of the blade when the movable member is in the selected extended position.

12. The method of claim 11, further comprising placing the movable member in a recess in the blade.

13. The method of claim 12, further comprising providing a fluid device that provides fluid under pressure to move the movable member from a retracted position to the selected extended position.

14. The method of claim 13, further providing a force device to move the movable member from the selected extended position to the retracted position.

15. The method of claim 13, wherein the fluid device includes a fluid flow control device that allows application of the fluid to the selected member to extend the selected member from the retracted position to the selected extended position.

16. The method of claim of claim 15, wherein the flow control device is one of: a pump; and a valve.

17. A method of drilling a wellbore, comprising:

conveying a drill string having a drill bit at an end thereof, wherein the drill bit includes:

a bit body having a blade of a selected length along a side of the bit body, the bit body having a longitudinal axis; and a movable member on the side of the bit body that extends from a retracted position along the longitudinal axis to a selected extended position to effectively extend the selected length of the blade when the moveable member is in the selected extended position; and drilling the wellbore using the drill string.

18. The method of claim 17, further comprising extending the movable member to the selected extended position when drilling a vertical well section.

19. A drilling system, comprising:

a drilling assembly having a drill bit at an end thereof configured to drill a wellbore, wherein the drill bit includes:

a bit body having a blade of a selected length along a side of the bit body, the bit body having a vertical axis; and a movable member on the side of the bit body that extends from a retracted position to a selected extended position along the longitudinal axis to effectively extend the selected length of the blade when the movable member is in the selected extended position.

20. The drilling system of claim 19, wherein the movable member includes a fluid flow device that moves the movable member from a retracted position to the selected extended position.

21. The drilling system of claim 20, further comprising a controller that controls the operation of the fluid flow device.

22. The drilling system of claim 21, wherein the controller is located at one of: a surface location; in the drilling assembly; in the drill bit; and partially in at least the drilling assembly and a surface location.

* * * * *